US005605036A

United States Patent [19]

Onuma et al.

[11] Patent Number: 5,605,036

[45] Date of Patent: Feb. 25, 1997

[54] STEEL CORDS FOR THE REINFORCEMENT OF RUBBER ARTICLES AND HAVING A WRAPPING CORD

[75] Inventors: Shuichi Onuma, Ohtawara; Naohiko Obana, Kuroiso; Kazuto Fujita; Motonori Bundo, both of Tokyo, all of Japan

[73] Assignee: Bridgestone Metalpha Corporation, Tokyo, Japan

[21] Appl. No.: 359,634

[22] Filed: Dec. 20, 1994

[30] Foreign Application Priority Data

Dec. 24, 1993 [JP] Japan ..... 5-328737

[51] Int. Cl.[6] ..... D02G 3/36; D07B 1/06

[52] U.S. Cl. ..... 57/212; 57/213; 57/214; 57/218; 57/230; 57/902

[58] Field of Search ..... 57/212, 902, 213, 57/214, 218, 230

[56] References Cited

FOREIGN PATENT DOCUMENTS

| | | |
|---|---|---|
| 49-47416 | 12/1974 | Japan . |
| 56-43006 | 4/1981 | Japan . |
| 63-240402 | 10/1988 | Japan . |
| 663187 | 8/1994 | Japan . |

*Primary Examiner*—William Stryjewski

*Attorney, Agent, or Firm*—Sughrue, Mion, Zinn, Macpeak & Seas

[57] ABSTRACT

A steel cord for the reinforcement of rubber articles exhibits largely different bending rigidities in two crossing directions at section of the cord and comprises a bundle of plural strands each being obtained by twisting 3 or more steel filaments and a wrapping filament helically wound around the bundle.

3 Claims, 6 Drawing Sheets

In-plane bending deformation

Out-of-plane bending deformation

STEEL CORDS FOR THE REINFORCEMENT OF RUBBER ARTICLES AND HAVING A WRAPPING CORD

BACKGROUND OF THE INVENTION

1. Field of the Invention

This invention relates to steel cords used as a reinforcing member for rubber articles such as pneumatic tires, industrial belts and the like. More particularly it relates to a steel cord having improved bending rigidity.

2. Description of the Related Art

In order to improve the steering performance and stability during the running of the vehicle, it is advantageous to increase a cornering force generated in a direction perpendicular to the running direction of the vehicle per a constant steering input. In order to increase the cornering force, it is required to increase the lateral slipping deformation of a land portion in a tread generated at a ground contact area of the tread during rotation of the tire. The quantity of such lateral slipping deformation is influenced by a deformation of a belt supporting the land portion of the tread or a deformation created in a belt layer shown in FIG. 1*a* in a plane of the belt layer or along the plane of the belt layer shown in FIG. 1*b* (hereinafter referred to as in-plane beginning deformation). That is, in order to produce a large cornering force, it is favorable to control the in-plane bending deformation of the belt and hence it is required to increase the ability to resist the in-plane bending deformation (hereinafter referred to as in-plane bending rigidity).

On the other hand, in order to improve the ground contacting property between the tire tread and the road surface, it is effective to sufficiently ensure a ground contacting area even against some irregularity of the road surface. For this purpose, it is required to decrease resistance to a deformation created in a direction perpendicular to the plane of the belt (hereinafter referred to as out-of-plane bending rigidity).

For achievement of bending rigidity required in the belt of the tire, therefore, it is required to rationalize bending ridigities in different in-plane and out-of-plane directions, respectively. These bending rigidities are influenced by the properties of steel cords used as a reinforcement for the belt. That is, the bending rigidity of the belt can be increased by using a steel cord having a high bending rigidity or by increasing an end count of steel cords in the belt.

On the other hand, a single twisting cord of 1×5 structure shown in FIG. 2*a* or a layer twisting cord of 2+6 structure shown in FIG. 2*b* is generally used as the steel cord used in the belt. In order to increase of the bending rigidity of these cords, it is effective to increase a diameter of a steel filament constituting the cord.

However, the structure of the above conventional steel cord is considered to be a rotating body centered around an axis of the cord, so that the structure is substantially uniform even in any directions crossing with the axis of the cord. As a result, the increase of the bending rigidity based on the increase of filament diameter acts on both of the in-plane bending rigidity and out-of-plane bending rigidity. That is, in the above conventional cord structures, there is a conflicting relation between the increase of in-plane bending rigidity and the decrease of out-of-plane bending rigidity. Therefore, the establishment of these requirements is difficult in the steel cords for the reinforcement of the belt.

As a solution for this task, there are proposed the following steel cords in which the bending rigidities of the cord are different in the bending directions.

For example, there are proposed a single steel filament having an ellipsoidal shape in section as shown in FIG. 3*a* and a cord obtained by twisting steel filaments of ellipsoidal shape in section as shown in FIG. 3*b*. In this case, it is difficult to conduct drawing at a high reduction of area while holding the ellipsoidal shape in section, so that there is a problem that a high tensile strength can not be obtained. Furthermore, the cord obtained by twisting of such flattened filaments has a problem in that it is difficult to twist these flattened filaments while setting the major axis (or minor axis) direction of the ellipse in each flattened filament.

Furthermore, the cord of a single twisting structure is flattened as shown in FIG. 3*c*, or the cord of layer twisting structure is rendered into the ellipsoidal shape in section by using two strands as a core in the cord as shown in FIG. 3*d*. In this case, the forming shapes of steel filaments constituting the cord differ in accordance with the position of the steel filament. That is, the curvature of the helically formed steel filament differs in the longitudinal direction of the filament. When the cord is bent, the movement of the filament followed to the bending hardly occurs and hence not only the bending rigidity in the major axis direction at the cord section but also the bending rigidity in a direction perpendicular thereto (the minor axis direction at the cord section) become high.

Moreover, there is a cord in which four steel filaments are arranged side by side and helically wrapped with a filament as shown in FIG. 3*e*. In this case, rigidity can largely be differed in accordance with the bending direction of the cord. However, in order to maintain the side-by-side state of the filaments and enhance the bending direction in the side-by-side direction, it is required to increase the clamping force of the wrapping filament, whereby the pressure between the filaments contacting each other in line becomes high and hence the fatigue property when being repeatedly subjected to bending input is considerably degraded. Also, it is technically difficult to increase the clamping force of the wrapping filament while maintaining the side-by-side state of the filaments.

On the other hand, JP-B-49-47416 proposes a metal cord formed by matching two metallic wires of S lay with two metallic wires of Z lay in longitudinal direction thereof and wrapping them with another wiring body. This cord is formed with a protruding portion in section for improving productivity and the adhesion property to rubber. However, since the cord is the combination of two kinds of two twisted metallic wires, a portion having a non-flattened shape at section is existent in the longitudinal direction of the cord, so that the bending rigidity in the longitudinal direction of the cord is discontinuous and hence there is a large problem in the fatigue property.

SUMMARY OF THE INVENTION

It is, therefore, an object of the invention to provide steel cords capable of giving a high in-plane bending rigidity and a low out-of-plane bending ridigity without using steel filaments having a thick filament diameter or an ellipsoidal shape in section as a reinforcement for a belt of a tire, in which the bending rigidities largely differ in two crossing directions at the section of the cord.

According to a first aspect of the invention, there is the provision of a steel cord for the reinforcement of rubber articles, in which a wrapping filament is helically wound around a bundle formed by contacting a plurality of strands, each of which strands being obtained by twisting 3 or more steel filaments, with each other and arranging them in the same plane.

In a preferable embodiment, the strands have the same structure and the twisting directions of the adjoining strands are opposite to each other.

According to a second aspect of the invention, there is the provision of a method of producing steel cords for the reinforcement of rubber articles by arranging a plurality of strands each obtained by twisting 3 or more steel filaments side by side and then helically winding a wrapping filament therearound, characterized in that the winding of the wrapping filament is carried out while applying to each strand a tension corresponding to $1/100$–$1/3$ of a tenacity of the strand.

In a preferable embodiment, a difference in the tension applied to the strand among the strands is within 10% of an average value of tensions applied to the strands.

According to a third aspect of the invention, there is the provision of a pneumatic tire comprising a carcass of a rubberized cord ply of a radial structure toroidally extending between a pair of bead portions and a belt superimposed about the carcass and comprised of at least one belt layer, characterized in that the belt layer is comprised of steel cords as defined in the first aspect of the invention in which the strands are arranged side by side in a widthwise direction of the belt.

DESCRIPTION OF THE PREFERRED EMBODIMENTS

Figure 1A:
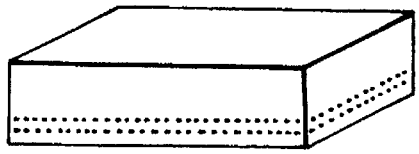
FIGS. 1*a*–1*c* are diagrammatic views illustrating behaviors of bending rigidities in a belt of a tire, respectively.
Figure 1B:
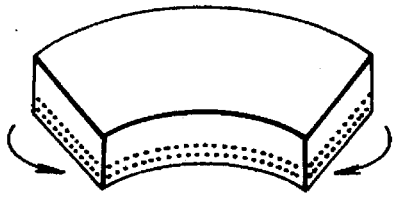
Figure 1C:
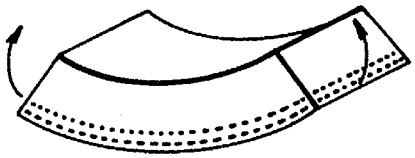

In FIGS. 4*a*–4*e* are sectionally shown various embodiments of the steel cord for the reinforcement of rubber articles according to the invention, respectively. In these figures, numeral 1 is a strand constituting the cord and obtained by twisting three or more steel filaments 2. A plurality of the strands 1 are contacted with each other and arranged side by side in the same plane to form a bundle, around which is helically wound a wrapping filament 3.

Furthermore, the structure of the strand 1 in each of the above cords is not particularly restricted as much as the strand is formed by twisting three or more steel filaments 2. That is, the strand 1 may have a 1×3 or 1×5 single twisting structure shown in FIGS. 4*a*–4*c*, a 2+6 layer twisting structure shown in FIG. 4*d*, a 3–4 bundle twisting structure shown in FIG. 4*e* and the like.

Moreover, the twisting direction of the strand in each cord is optional. For example, the twisting directions of the strands are the same in FIG. 4*c*, while the twisting directions of the adjoining strands are opposite in FIGS. 4*a*–4*b* and 4*d*–4*e*.

In the cords according to the invention, the bending rigidities in two crossing directions at section thereof largely differ, so that when such a cord is applied to a belt of a tire, the cornering force can be increased.

In the production of the steel cord according to the invention, a plurality of strands each obtained by twisting 3 or more steel filaments are arranged side by side and then a wrapping filament is helically wound therearound. In the helical winding of the wrapping filament, it is important that a tension corresponding to $1/100$–$1/3$ of a tenacity of the strand is applied to each strand, for example, by adjusting a delivery rate of the strand from a take-up reel.

In this case, it is preferable that the difference in the tension applied to the strand among the strands is controlled to 10% of an average value of tensions applied to the strands.

Moreover, the twisting pitch in the strand and the wrapping filament is not particularly critical, but it is favorable that the twisting pitch in the strand is 3.0–30.0 mm and the twisting pitch in the wrapping filament is 2.0–15.0 mm.

That is, when the twisting pitch of the strand is less than 3.0 mm, filament breakage is apt to be caused in production of the cord and the productivity lowers. When it exceeds 30.0 mm, the twisting property such as straightness of the strand or the like is degraded. On the other hand, when the twisting pitch of the wrapping filament is less than 2.0 mm, it is difficult to arrange the strands side by side in the same plane. When it exceeds 15.0 mm, the cord property such as straightness or the like is degraded.

According to the invention, 2 or more strands are arranged side by side and the wrapping filament is wound therearound to impart a high restraint force to a contacting portion between the strands, whereby a high bending rigidity in the side-by-side direction of the strand can be obtained, which has never been attained in the combination of only the strands.

The reason why the number of steel filaments constituting the strand is 3 or more is due to the fact that when using two steel filaments, the outer periphery of the strand in section largely is not circular and hence the section of the cord obtained by arranging the strands side by side is not constant in an axial direction of the cord and a portion having no ellipsoidal shape in section is formed and consequently the given bending rigidity is not obtained.

Furthermore, the strong restraint based on the contact between adjoining strands is maintained by helically winding the wrapping filament around the bundle of the strands. That is, when using no wrapping filament, the contact between the adjoining strands is not restrained. Thus, when bending is caused in the side-by-side direction of the strand, the bending stress distribution in the strand is equal to that of the strand alone and hence the bending rigidity can not be increased. On the contrary, when using the wrapping filament, the restraint at the contacting portion between the adjoining strands can be enhanced to obtain a high bending rigidity.

Moreover, the above restraint effect can be further ensured by opposing the twisting directions of the adjoining strands and engaging steel filaments constituting the adjoining strands with each other. Even if the twisting directions of the adjoining strands are the same, the engagement of the filaments is somewhat created and the restraint effect can be expected as compared with the cord formed by arranging single filaments side by side.

In the production of the steel cord according to the invention, each of the strands is fixed at inlet and outlet sides of a wrapping machine for the wrapping filament, whereby the winding of the wrapping filament can be carried out at a state that the strands are arranged side by side in the same plane. Furthermore, the side-by-side state of the strands can be further ensured by passing the wrapping filament through correction rolls after the winding.

When the tension applied to each strand in the winding of the wrapping filament is less than 1/100 of the tenacity of the strand, loosening of the cord is caused and the side-by-side state in the same plane can not be realized. When it exceeds 1/3, the filament breakage in the cord is apt to be caused and also flaws are apt to be caused by forming rolls and the like. Furthermore, when the difference in the tension between the adjoining strands exceeds 10%, the straightness of the cord is degraded.

When the steel cords according to the invention are applied to a belt in a pneumatic tire to arrange the strands constituting the cord side by side in the widthwise direction of the belt, in-plane bending rigidity in the belt can be increased to suppress the deformation in the cornering of the tire, while the out-of-plane bending rigidity in the belt is decreased to improve the ground contacting property against irregularity of road surface. As a result, the performance of the tire as a whole are improved and particularly steering stability is excellent.

The following examples are given in illustration of the invention and are not intended as limitations thereof.

EXAMPLE 1

Steel cords of various structures shown in FIGS. 2–4 are prepared by using steel filaments having a filament diameter of 0.15–0.35 mm made from a high carbon steel containing C: 0.70–0.85 wt % according to a specification shown in Table 1.

That is, the steel filaments constituting the cord and having given filament diameter and tensile strength are obtained by using a high carbon steel wire having a diameter of 5.5 mm as a starting material and subjecting then to heat treatment and drawing treatment. Then, these steel filaments are used to form strands of single twisting, layer twisting and bundle twisting structures, respectively. Two or more strands are arranged side by side and a wrapping filament is wound therearound to form a steel cord according to the invention. In winding of the wrapping filament, a plurality of strands are arranged side are by side are guided through a guide roll to stably arrange these strands side by side in the same plane before and after the winding. After the winding of the wrapping filament, the resulting cord is passed through a correction device comprised of zigzag arranged roll groups to more stably arrange the strands side by side.

Moreover, the arrangement of the strands can be carried out by using a guide piece or a dies instead of the above rolls. Also, the cords having a more stable side-by-side state can be obtained by providing a flat groove on a guide member for the strand such as guide roll, correction roll, pulley, capstan or the like.

Figure 2A:
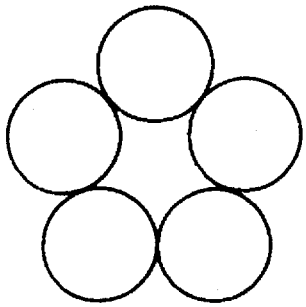
FIG 2a PRIOR ART
FIGS. 2*a* and 2*b* are schematically sectional views of the conventional steel cords, respectively.
Figure 2B:
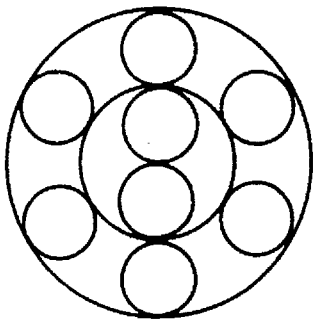
FIG 2b PRIOR ART
Figure 3A:
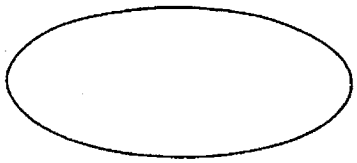
FIG 3a PRIOR ART
FIGS. 3*a*–3*e* are schematically sectional views of the other conventional steel cords, respectively.
Figure 3B:
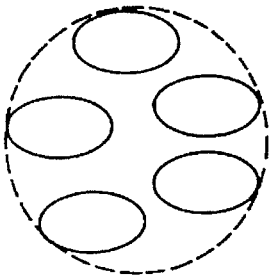
FIG 3b PRIOR ART
Figure 3C:
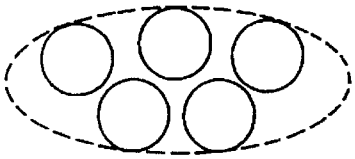
FIG 3c PRIOR ART
Figure 3D:
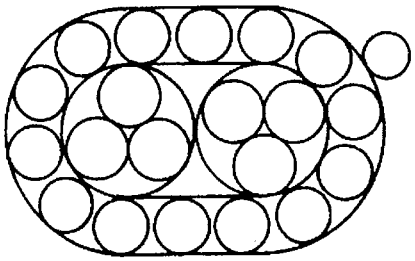
FIG 3d PRIOR ART
Figure 3E:
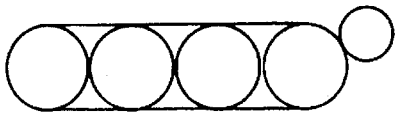
FIG 3e PRIOR ART

For comparison, steel cords shown in FIGS. 2*a* and 2*b* are used as a conventional example, while steel cords shown in FIGS. 3*c*–3*e* are used as a comparative example.

The steel cords are embedded in rubber to form a composite body and cured, from which is taken out a specimen for the evaluation of the bending rigidity having a length of 100 mm, a width of 10 mm and a thickness of 3 mm in which one cord is located in a center of the specimen. In this case, there are prepared two kinds of specimens for every cord in which the major axis of the cord at section thereof is directed in the widthwise direction and thickness direction of the specimen, respectively.

Figure 5:
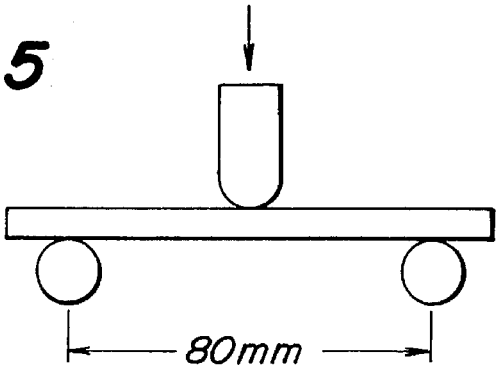
FIG. 5 is a diagrammatic view illustrating an evaluation of bending rigidity.

The thus obtained specimens are subjected to a three-point bending test to measure bending rigidities in two crossing directions at the section of the cord. In the three-point bending test, the specimen is placed on two supports separated from each other at a distance of 80 mm and a bending tool is placed on the central part of the specimen as shown in FIG. 5, and then a load is applied to the specimen at a rate of 1 mm/min, during which an initial inclination value in bending load—bending distortion curve is measured as a bending rigidity. Further, the anisotropy in the bending rigidity of the cord is evaluated by a ratio of bending rigidity in major axis direction of the cord in section to bending rigidity in a direction perpendicular thereto. The larger the value of the ratio, the better the bending property. Concretely, the value of not less than 2.5 is good in bending property.

The evaluation of results is shown in Table 1 together with filament diameter and twisting structure of the cord and the like. As seen from Table 1, in the steel cords according to the invention, the high bending rigidity is obtained and the anisotropy is large as compared with the steel cords of conventional examples and comparative examples.

TABLE 1

Figure 4A:
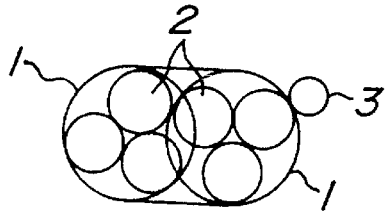
FIGS. 4*a*–4*e* are schematically sectional views of steel cords according to the invention, respectively.
Figure 4B:
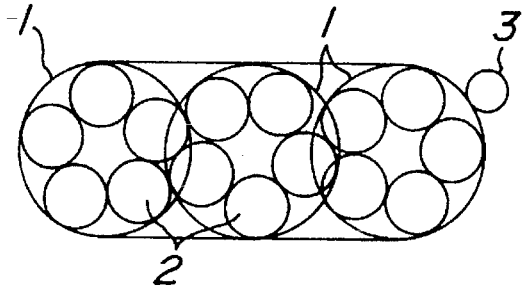
Figure 4C:
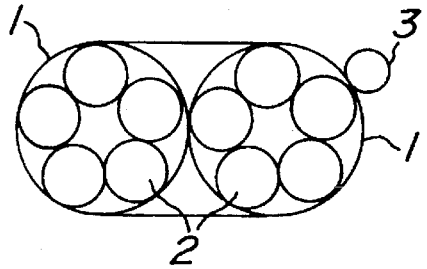
Figure 4D:
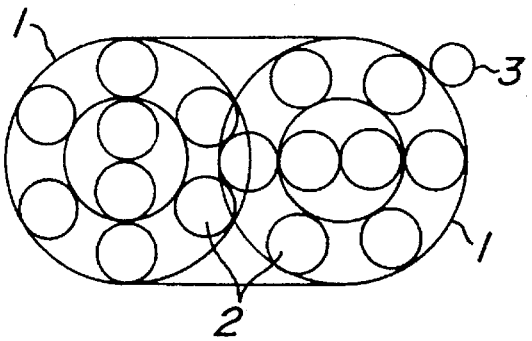

| Cord No. | Cord structure | Strand twisting pitch (mm) | Wrap twisting pitch (mm) | FIG. corresponding to basic structure | Twisting direction of outermost layer | Forming ratio | Index of bending anisotropy | Remarks |
|---|---|---|---|---|---|---|---|---|
| 1 | 1 × 5 × 0.23 | 9.5 | — | FIG. 2a | | 128 | 1.0 | Conventional |
| 2 | 2 + 6 × 0.23 | 6.0/12.0 | — | FIG. 2b | | — | 1.0 | Example |
| 3 | 2(1 × 5 × 0.20) + 1 × 0.15 | 9.5 | 5.5 | FIG. 4c | S-Z | 125 | 9.6 | Acceptable |
| 4 | 2(1 × 5 × 0.20) + 1 × 0.15 | 9.5 | 5.5 | FIG. 4c* | S-S | 125 | 4.5 | Example |
| 5 | 2(1 × 5 × 0.25) + 1 × 0.15 | 9.5 | 5.5 | FIG. 4c | S-Z | 126 | 8.4 | |
| 6 | 2(1 × 5 × 0.25) + 1 × 0.15 | 9.5 | 5.5 | FIG. 4c | S-Z | 100 | 7.5 | |
| 7 | 2(1 × 3 × 0.20) + 1 × 0.15 | 9.5 | 5.5 | FIG. 4a | S-Z | 123 | 7.5 | |
| 8 | 3(1 × 4 × 0.20) + 1 × 0.15 | 9.5 | 7.5 | — | S-Z-S | 125 | 20.8 | |
| 9 | 4(1 × 3 × 0.20) + 1 × 0.15 | 9.5 | 8.5 | — | S-Z-S-Z | 123 | 30.3 | |
| 10 | 2(1 + 6 × 0.30) + 1 × 0.15 | 12.0 | 6.5 | — | S-Z | — | 8.2 | |
| 11 | 2(1 CR + 6 × 0.30) + 1 × 0.15 | 12.0 | 6.5 | | S-Z | — | 9.3 | |
| 12 | 2(1 × 2 + 6 × 0.23) + 1 × 0.15 | 6.0/12.0 | 6.5 | FIG. 4d | S-Z | — | 8.8 | |
| 13 | 2(1 × 3 + 8 × 0.20) + 1 × 0.175 | 6.0/12.0 | 6.5 | — | S-Z | — | 9.5 | |
| 14 | 2(1 × 3 + 9 × 0.20) + 1 × 0.175 | 6.0/12.0 | 6.5 | — | S-Z | — | 9.6 | |

TABLE 1-continued

Figure 4E:
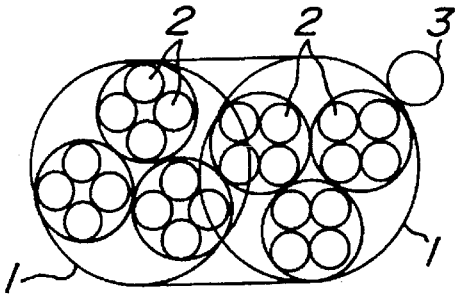

| Cord No. | Cord structure | Strand twisting pitch (mm) | Wrap twisting pitch (mm) | FIG. corresponding to basic structure | Twisting direction of outermost layer | Forming ratio | Index of bending anisotropy | Remarks |
|---|---|---|---|---|---|---|---|---|
| 15 | 2(1 × 3 × 0.20 + 5 × 0.35) + 1 × 0.175 | 10.0/18.0 | 6.5 | — | S-Z | — | 8.9 | |
| 16 | 2(1 × 3 × 0.15 + 9 × 0.15 + 15 × 0.15) + 1 × 0.15 | 5.5/10.5/15.5 | 6.5 | — | S-Z | — | 7.8 | |
| 17 | 2(1 × 3 × 4 × 0.15) + 1 × 0.15 | 3.0/5.0 | 5.5 | FIG. 4e | S-Z | — | 7.9 | |
| 18 | 2(1 × 3 × 0.23 + 9 × 0.23 CC) + 1 × 0.175 | 12.0/12.0 | 6.5 | — | S-Z | — | 7.2 | |
| 19 | 2(1 × 3 × 0.20) + 14 × 0.175 + 1 × 0.15 | 9.5/15.0 | 3.5 | FIG. 3d | | — | 2.4 | Comparative |
| 20 | 1 × 5 × 0.23(super-flat forming) | 9.5 | — | FIG. 3c | | 140~96 | 1.5 | Example |
| 21 | 4(1 × 0.35) + 1 × 0.15 | ∞ | 3.5 | FIG. 3e | | — | 35.8 | |

*Twisting direction is same

EXAMPLE 2

Figure 6:
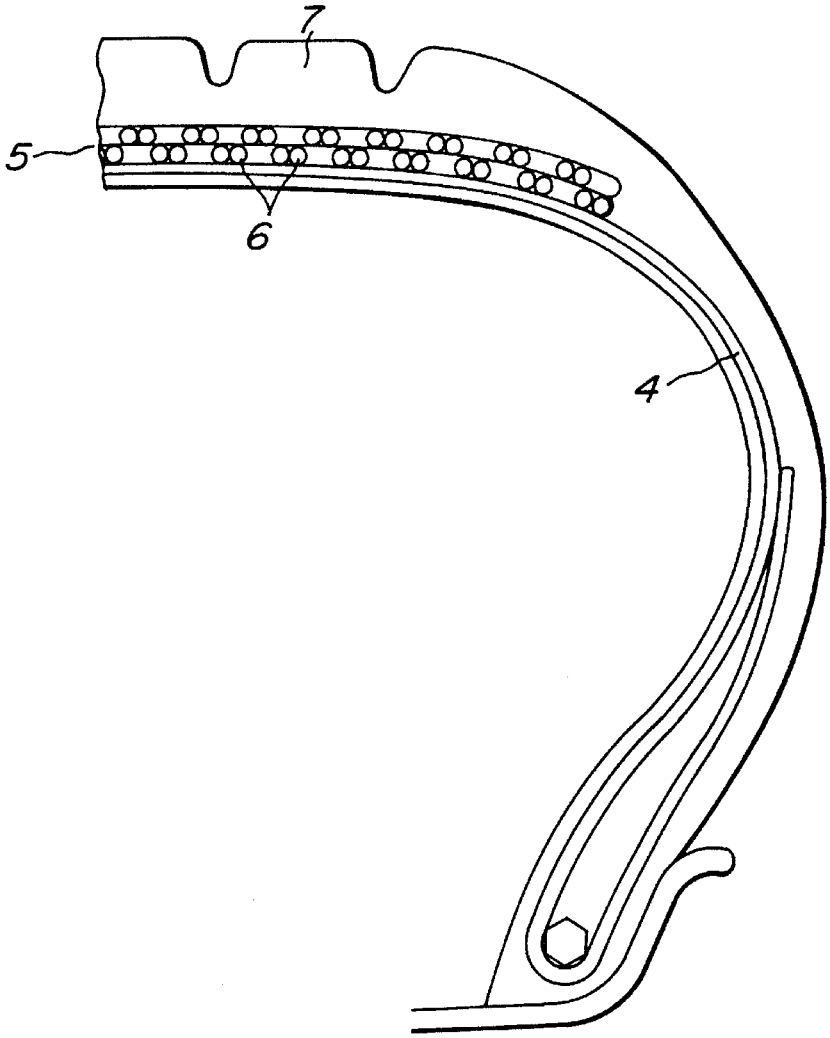
FIG. 6 is a diagrammatically section view of an embodiment of the pneumatic tire according to the invention.
Figure 7:
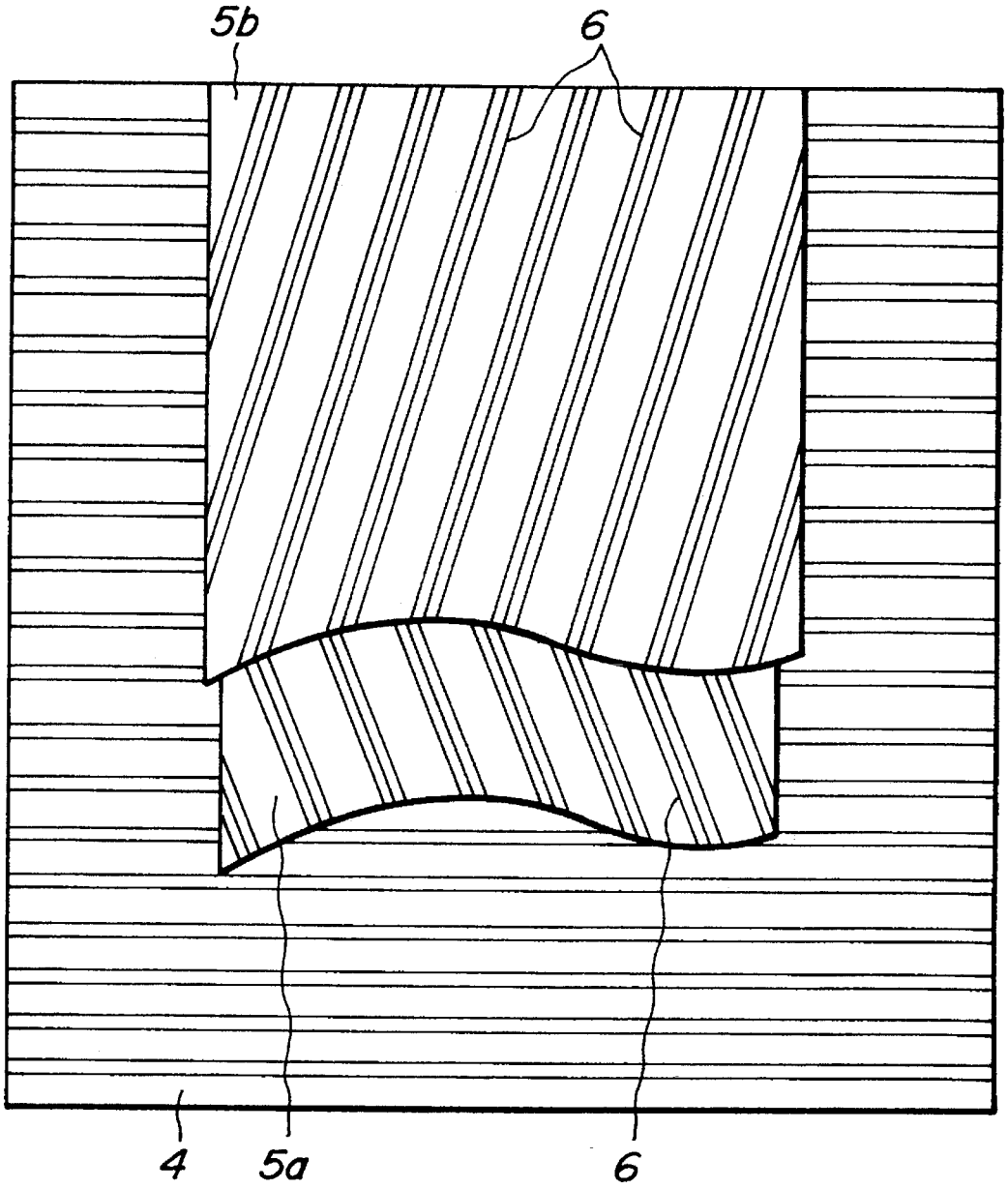
FIG. 7 is a diagrammatic view illustrating a belt structure in the tire according to the invention.

A test tire having a tire size of 195/65R14 and a structure shown in FIG. 6 is manufactured by applying the steel cords of Example 1 to a belt in the tire. That is, the steel cords are applied to each of two belt layers in a belt 5 disposed on a crown portion of a carcass 4 outward in the radial direction of the tire. Moreover, numeral 6 is a steel cord in the belt layer, and numeral 7 is a tread. As shown in FIG. 7, the belt 5 is comprised of a first belt layer 5*a* arranged on the carcass 4 and containing steel cords inclined at a cord angle of 20° with respect to an equatorial plane of the tire upward to the left, and a second belt layer 5*b* arranged on the first belt layer and containing steel cords inclined at a cord angle of 20° with respect to the equatorial plane upward to the right. In each belt layer, the end count of steel cords is adequately adjusted so that the total tenacity of the belt is constant irrespective of the kind of the cord.

The cornering force depending upon the steering stability of the vehicle is measured with respect to the thus obtained tires. In this case, the tire is mounted onto a standard rim, inflated under an inner air pressure of 2.0 kgf/cm$^2$ and run on a flat belt type testing machine for the measurement of cornering property at a speed of 50 km/h and a slipping angle of ±2° under a load of 520 kg, during which the cornering force is measured. An average of the measured values is shown in Table 2. The cornering force is evaluated by an index value on the basis that the measured value of cornering force in the conventional example (cord structure: 1×5×0.23 mm) is 100. As shown in Table 2, the tires in which the steel cord according to the invention is used in the belt are large in the cornering force, which is remarkable as the anisotropy of the bending rigidity of the cord becomes large.

Furthermore, the tire is mounted on a passenger car and run on a test course, during which the steering stability is evaluated by a feeling test of a professional driver. The evaluation results are also shown in Table 2. In this case, the steering stability is represented by an index value on the basis that the feeling evaluation in the conventional example (cord structure: 1×5×0.23 mm) is 100. As seen from the results of Table 2, the tires using the steel cords according to the invention develop good results even in the feeling evaluation on actual running test.

TABLE 2

| Cord No. | Cord structure | Cornering force | Feeling evaluation | Remarks |
|---|---|---|---|---|
| 1 | 1 × 5 × 0.23 | 100 | 100 | Conventional Example |
| 2 | 2 + 6 × 0.23 | 101 | 101 | |
| 3 | 2(1 × 5 × 0.20) + 1 × 0.15 | 105 | 105 | Acceptable Example |
| 4 | 2(1 × 5 × 0.20) + 1 × 0.15 | 104 | 106 | |
| 5 | 2(1 × 5 × 0.25) + 1 × 0.15 | 104 | 105 | |
| 6 | 2(1 × 5 × 0.25) + 1 × 0.15 | 103 | 104 | |
| 7 | 2(1 × 3 × 0.20) + 1 × 0.15 | 104 | 103 | |
| 8 | 3(1 × 4 × 0.20) + 1 × 0.15 | 108 | 108 | |
| 9 | 4(1 × 3 × 0.20) + 1 × 0.15 | 108 | 110 | |
| 10 | 2(1 + 6 × 0.30) + 1 × 0.15 | 105 | 104 | |
| 11 | 2(1 CR + 6 × 0.30) + 1 × 0.15 | 105 | 104 | |
| 12 | 2(1 × 2 + 6 × 0.23) + 1 × 0.15 | 103 | 104 | |
| 13 | 2(1 × 3 + 8 × 0.20) + 1 × 0.175 | 105 | 105 | |
| 14 | 2(1 × 3 + 9 × 0.20) + 1 × 0.175 | 105 | 105 | |
| 15 | 2(1 × 3 × 0.20 + 5 × 0.35) +1 × 0.175 | 104 | 105 | |
| 16 | 2(1 × 3 × 0.15 + 9 × 0.15 + 15 × 0.15) +1 × 0.15 1 × 0.15 | 104 | 105 | |
| 17 | 2(1 × 3 × 4 × 0.15) + 1 × 0.15 | 104 | 105 | |
| 18 | 2(1 × 3 × 0.23 + 9 × 0.23 CC) + 1 × 0.175 | 104 | 102 | |
| 19 | 2(1 × 3 × 0.20) + 14 × 0.175 + 1 × 0.15 | 101 | 100 | Conventional Example |
| 20 | 1 × 5 × 0.23 (super-flat forming) | 100 | 100 | |
| 21 | 4(1 × 0.35) + 1 × 0.15 | 100 | 100 | |

As mentioned above, the steel cords according to the invention have a high anisotropy in the bending rigidity, so that when they are applied to the belt in the tire, in-plane bending rigidity can be increased without increasing the out-of-plane bending rigidity and the steering stability can be enhanced without lowering the gripping force during the running of the tire. That is, the invention has very useful merits in industry.

What is claimed is:

1. A steel cord for the reinforcement of rubber articles, in which a wrapping filament is helically wound around a bundle formed by contacting a plurality of strands, each of which strands being obtained by twisting 3 or more steel filaments, with each other and arranging them in the same plane, and wherein each of said strands has a 1×5 single twisting structure.

2. A steel cord for the reinforcement of rubber articles, in which a wrapping filament is helically wound around a bundle formed by contacting a plurality of strands, each of which strands being obtained by twisting 3 or more steel filaments, with each other and arranging them in the same plane, and wherein each of said strands has a 2+6 layer twisting structure.

3. A steel cord for the reinforcement of rubber articles, in which a wrapping filament is helically wound around a bundle formed by contacting a plurality of strands, each of which strands being obtained by twisting 3 or more steel filaments, with each other and arranging them in the same plane, and wherein each of said strands has a 3×4 layer twisting structure.

* * * * *